United States Patent [19]

Owens, Jr.

[11] Patent Number: 5,065,777

[45] Date of Patent: Nov. 19, 1991

[54] THERMALLY STABLE ASH CONDITIONERS FOR CIGARETTE PAPER, METHODS OF MAKING SUCH CIGARETTE PAPER AND SMOKING ARTICLES MADE FROM SUCH WRAPPERS—CASE III

[75] Inventor: William F. Owens, Jr., Pisgah Forest, N.C.

[73] Assignee: P. H. Glatfelter Company, Spring Grove, Pa.

[21] Appl. No.: 514,886

[22] Filed: Apr. 26, 1990

[51] Int. Cl.[5] ..... A24D 1/02
[52] U.S. Cl. ..... 131/365
[58] Field of Search ..... 131/365; 162/139

[56] References Cited

U.S. PATENT DOCUMENTS

| | | |
|---|---|---|
| 4,231,377 | 11/1980 | Cline et al. . |
| 4,450,847 | 5/1984 | Owens . |
| 4,461,311 | 7/1984 | Mathews et al. . |
| 4,805,644 | 2/1989 | Hampl, Jr. et al. . |
| 4,881,557 | 11/1989 | Martin . |
| 4,915,118 | 4/1990 | Kaufman et al. . |

*Primary Examiner*—J. Millia
*Attorney, Agent, or Firm*—Kerkam, Stowell, Kondracki & Clarke

[57] ABSTRACT

A cigarette paper is disclosed which, when fabricated into a cigarette with a suitable tobacco column, statically burns at an acceptable rate, produces a light-colored, well-formed ash which clings tightly without premature flaking, and delivers both mainstream and sidestream smoke with a subjectively pleasant taste and aroma.

11 Claims, 2 Drawing Sheets

* TOTAL PARTICULATE MATERIAL

THERMALLY STABLE ASH CONDITIONERS FOR CIGARETTE PAPER, METHODS OF MAKING SUCH CIGARETTE PAPER AND SMOKING ARTICLES MADE FROM SUCH WRAPPERS—CASE III

SUMMARY OF THE INVENTION

This invention provides a cigarette paper which, when fabricated into a cigarette with a suitable tobacco column, statically burns at an acceptable rate, produces a light-colored, well-formed ash which clings tightly without premature flaking, and delivers both mainstream and sidestream smoke with a subjectively pleasant taste and aroma. More specifically, these desirable smoking properties are achieved by incorporating a thermally stable ash conditioner, such as potassium chloride, into the cigarette paper. Furthermore, use of a thermally stable ash conditioner is particularly effective with heavy basis weight cigarette papers which contain unusual types and/or high levels of inorganic fillers in the range of 14 to 60 g/m$^2$; e.g , 45 g/m$^2$ magnesium hydroxide/calcium carbonate-filled, reduced sidestream smoke cigarette paper.

BACKGROUND OF THE INVENTION

The reduced sidestream smoke cigarette paper patents which describe magnesium oxide/hydroxide as paper fillers, and which define burning chemical types and levels are U.S. Pat. Nos. 4,231,377; 4,450,847; 4,881,557 and 4,915,118. These patents claim alkali metal acetates, citrates, nitrates carbonates, and tartrates as burning chemical types at levels in the sheet ranging from 0.5% to 8.0%.

Other patents directed to reduced sidestream smoke cigarette paper are U.S. Pat. Nos. 4,461,311 and 4,804,644. These patents disclose the sodium and potassium salts of carbonic, formic, acetic, propionic, malic, lactic, glycolic, citric, tartaric, fumaric, oxalic, malonic, nitric, and phosphoric acids at levels in the sheet up to 25% by weight.

A BRIEF DESCRIPTION OF DRAWINGS WHICH CHARACTERIZE THE INVENTION

The invention will be described, in detail, in reference to the accompanying drawings wherein:

FIG. 1 is a chart illustrating the effect of potassium level on static burn rates of cigarettes wrapped in reduced sidestream paper; and FIG. 2 is a chart showing the effect of potassium level on reduced sidestream cigarette paper sidestream smoke delivery rate.

DETAILED DESCRIPTION OF THE INVENTION

During the course of developing an acceptable magnesium hydroxide-filled, reduced sidestream smoke cigarette paper, it was found that high levels of a conventional burning chemical, such as potassium acetate, were required to achieve an acceptable ash formation and appearance. Unfortunately at very high levels of potassium acetate burning chemical, the sheet becomes "wet" and an undesirable harshness and aftertaste was imparted to the taste and aroma of mainstream and sidestream smoke. Consequently, it was postulated that the thermal decomposition products from the relatively large amounts (10 to 40 times greater than normally applied) of potassium acetate burning chemical were attributing to this negative taste and aroma impact. Furthermore, it was believed that an inorganic compound which did not thermally decompose over the range of temperatures encountered in a burning cigarette (ambient to 1050° C.), possessed a melting point less than 1050° C. and boiled or sublimed at least 300° C. above 1050° C. would condition the ash by means of simple melt fusion and not contribute thermal decomposition products to the mainstream or sidestream smoke. The alkali metal halides fulfill these requirements admirably, as shown in Table I. Furthermore, it has been shown that these inorganic compounds adsorb very little water upon exposure to ambient atmosphere, whereas the usual burning chemicals, such as the alkali metal salts of carboxylic acids, are very hydroscopic. Also, the alkali metal halides exert little, if any, effect on the static burning rate of cigarette paper treated over a large range of concentrations. Indeed, they function purely as ash conditioners, being neither burning rate accelerators nor retardants.

EXAMPLE I

Figure 1:
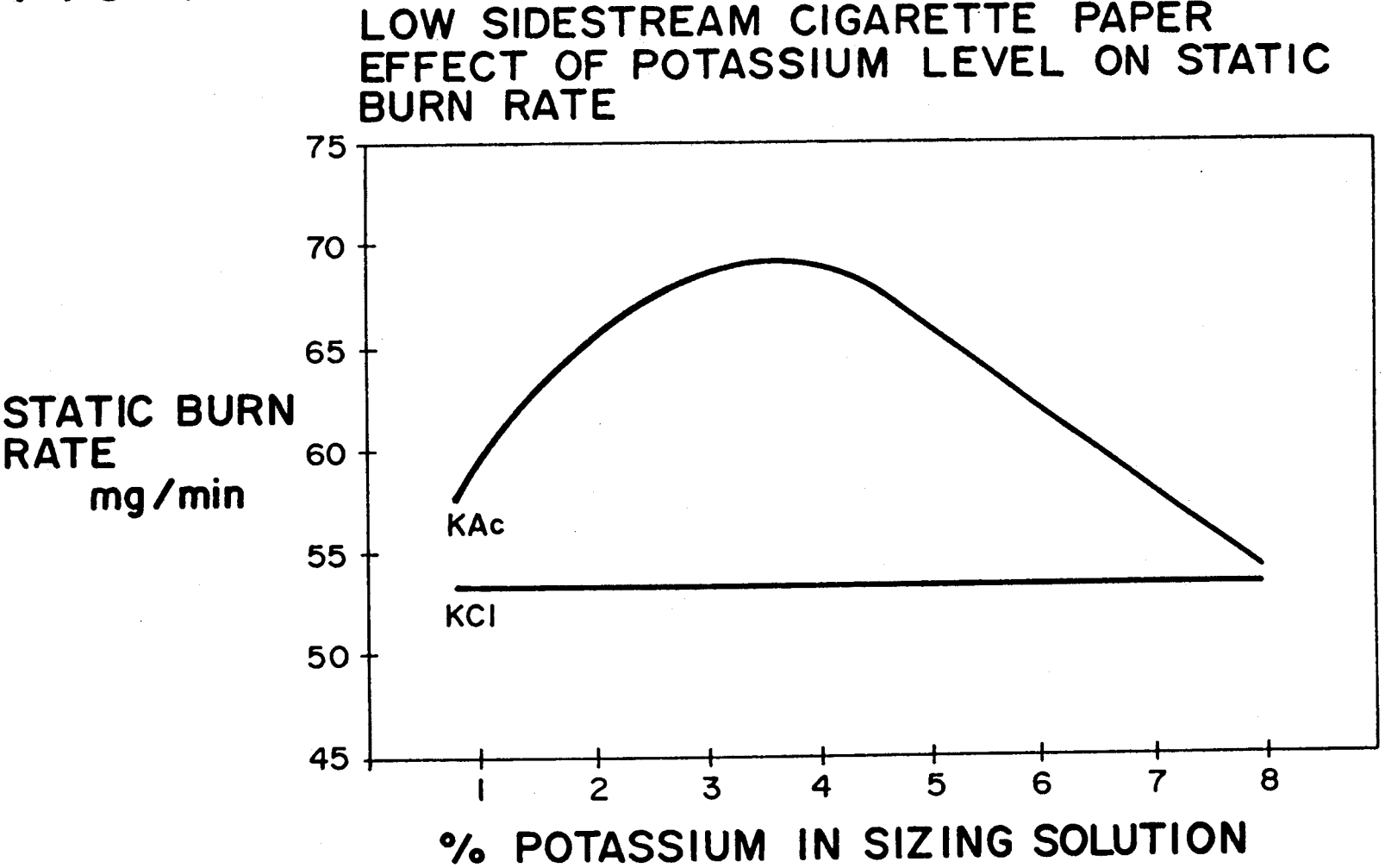
Figure 2:
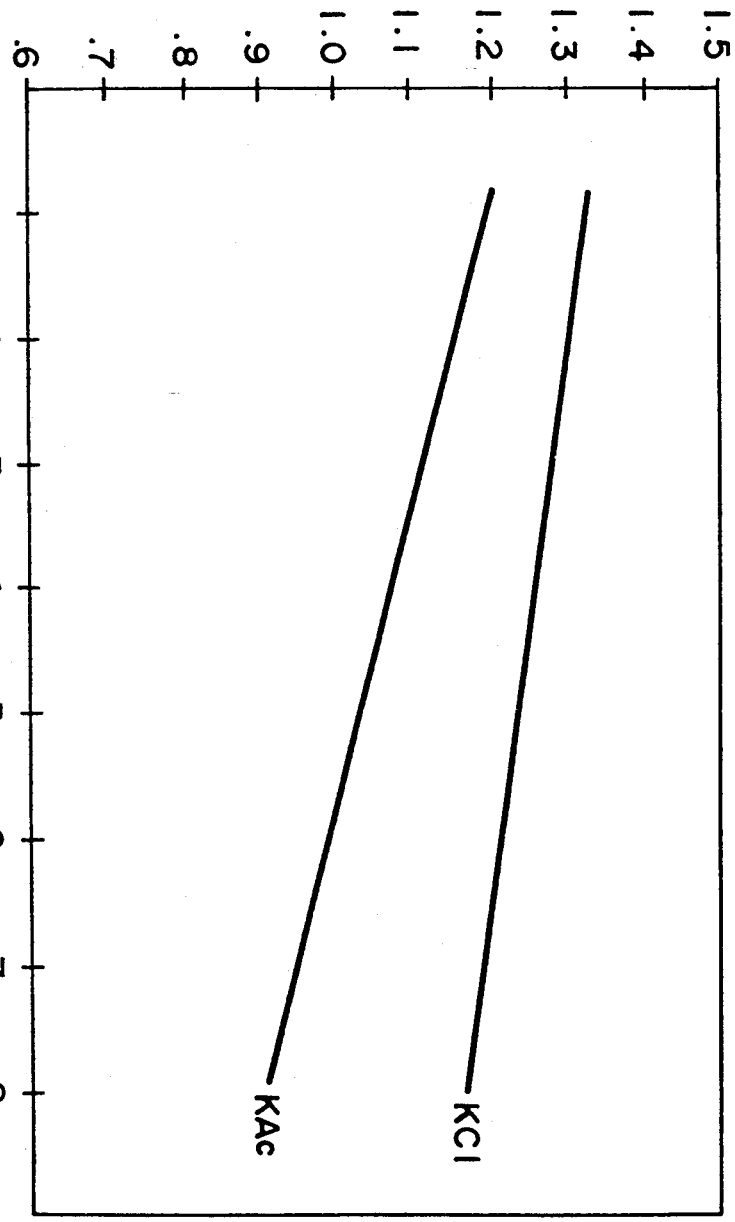

Reduced sidestream smoke cigarette paper, containing 15% precipitated $Mg(OH)_2$ and 25% calcium carbonate fillers, and weighing 45 g/M$^2$ was size-press treated with aqueous solutions of potassium chloride and potassium acetate containing potassium cation levels from 0.8 to 8.0% by weight. Cigarettes were prepared and smoked for static burning rate and sidestream smoke delivery rate. The smoking results are shown in FIGS. 1 and 2. In FIG. 1, the potassium acetate curve displays the "classic maxima" in static burning rate typical of alkali metal salts of carboxylic acids, whereas the potassium chloride curve is absolutely flat with increasing cation concentration. In FIG. 2, both the potassium acetate and chloride curves demonstrate a modest decrease in sidestream TPM (Total Particulate Matter) delivery rate with increasing potassium cation level; however, the two curves are offset by 0.1 to 0.3 mg/min TPM delivery rate. The reduced sidestream TPM delivery rate shown by potassium acetate relative to that of potassium chloride is expected and is probably due to the hydroscopic nature of potassium acetate. It has been found that the deliquescent potassium acetate crystallites in the sheet form effective nuclei for efficient condensation of both the liquid phase droplets in the smoke aerosol and the volatile steam distillable organic pyrolysis products passing down the tobacco column. These condensed smoke and pyrolysis components are then further decomposed to lower molecular weight molecules and gases which do not contribute to the visible sidestream smoke plume. Also, it is noteworthy that the linear character of both the sidestream TPM delivery rate curves in FIG. 2 are totally unlike the curves presented in U.S. Pat. No. 4,461,311, Mathews et al, July 24, 1984.

EXAMPLE II

Table II presents the ash characteristics of cigarettes wrapped in 45 g/m$^2$ reduced sidestream smoke cigarette papers treated with various burning chemicals and ash conditioners. Note that the puffed-ash appearance and formation of the various alkali metal halide treated papers is comparable to that from the potassium acetate treated papers, thereby confirming the efficacy of alkali metal halide salts as ash conditioners.

EXAMPLE III

In an effort to determine the effect of various burning chemicals on the thermal decomposition product distribution from cigarette paper, a 25g/m$^2$ nonporous (500mm Filtrona porosity), 20% $CaCO_3$ filled, 100% flax cigarette paper sheet was treated with various burning chemicals and ash conditioners and then directly burned under controlled conditions. Combustion products were subsequently analyzed. The direct combustion of the treated paper samples in a synthetic combustion gas mixture (10.5% $O_2$ in He) at one atmosphere gauge pressure avoids the enormous complexity associated with analyzing the combustion products from a burning cigarette. At least a tenfold reduction in the number of combustion products is affected. The specific analysis is performed by the PP/GC/MS analytical technique (pyroprobe pyrolysis/gas chromatography/-mass spectrometry). The concentration of the potassium salt treating solutions was selected so that each solution contained 6% potassium cation by weight. The potassium chloride, nitrate, phosphate ($K_2HPO_4$), citrate and acetate-treated papers were evaluated, as well as the untreated sheet water-on-size press. Quantitatively, the potassium chloride-treated paper provides a combustion product distribution very similar to that of the untreated paper. Other organic and inorganic burning chemicals all thermally decompose and appear to cause extensive alteration of the quantitative combustion product distribution. This would certainly explain why the potassium chloride ash conditioner contributes little, if any, negative taste and aroma impact to mainstream and sidestream smoke.

TABLE I

THERMAL PROPERTIES OF ALKALI METAL HALIDES

| COMPOUND | MELTING POINT (°C.) | BOILING POINT (°C.) |
|---|---|---|
| KF | 846 | 1505 |
| KCl | 776 | 1500 (Sublimas) |
| KBr | 730 | 1435 |
| KI | 686 | 1330 |
| NaF | 988 | 1695 |
| NaCl | 801 | 1413 |
| NaBr | 755 | 1390 |
| NaI | 651 | 1304 |

TABLE II

ASH APPEARANCE OF REDUCED SIDESTREAM SMOKE CIGARETTE PAPER

| SIZE PRESS TREATMENT | PUFFED ASH CHARACTERISTICS | | | |
|---|---|---|---|---|
| | ADHESION | COLOR | FALLOFF | SOLIDITY |
| 12% KCl | EXCELLENT CLING | LIGHT GREY | NO ASH FALLS | PERFECTLY SOLID |
| 12% KF | EXCELLENT CLING | WHITE | NO ASH FALLS | PERFECTLY SOLID |
| 9% KCl | EXCELLENT CLING | LIGHT GREY | NO ASH FALLS | PERFECTLY SOLID |
| 5.1% NaCl | EXCELLENT CLING | LIGHT GREY | NO ASH FALLS | PERFECTLY SOLID |

SUMMARY

Alkali halides, such as potassium chloride, when applied in a size press treatment to cigarette paper, particularly reduced sidestream smoke cigarette paper, function purely as an ash conditioner having little effect, if any, on static burn rate while affecting a satisfactory ash formation and appearance. Furthermore, application of the alkali halide ash conditioners does not seem to have the adverse impact on the cigarette smoke taste and aroma which high levels of normal, decomposable burning chemicals impart.

In carrying out this invention, it has been found that the total alkali metal in the sheet should be from about 2% to about 24% of the total weight of the sheet, and a preferred range would be about 3% to about 10%.

I claim:

1. A wrapper for smoking articles, comprising a cellulosic sheet, filler concentrations in said sheet in the range of 14 to 60 g/m$^2$, and a thermally stable, at the range of temperatures encountered in a burning smoking article, alkali metal ash conditioner in the sheet at a level of from about 2% to about 24% of the total weight of the sheet.

2. The wrapper, as defined in claim 1, wherein the alkali metal is selected from the group consisting of KF, KCl, KBr, KI, NaF, NaCl, NaBr and NaI.

3. The wrapper, as defined in claim 2, wherein the conditioner is applied at the size press.

4. The wrapper, as defined in claim 2, wherein the conditioner is selected from a group consisting of KCl and NaCl.

5. A smoking article comprising a tobacco charge and a wrapper for the tobacco charge, said wrapper comprising a cellulosic sheet, filler concentrations in said sheet in the range of 14 to 60 g/m$^2$, and a thermally stable, at the range of temperatures encountered in a burning smoking article, alkali metal ash conditioner on the sheet at a level of from about 2% to about 24% of the total weight of the sheet.

6. The smoking article, as defined in claim 5, wherein the alkali metal is selected from the group consisting of KF, KCl, KBr, KI, NaF, NaCl, NaBr and NaI.

7. The smoking article, as defined in claim 6, wherein the conditioner is applied at the size press.

8. The smoking article, as defined in claim 7, wherein the conditioner is applied from aqueous solution thereof.

9. A method of improving the taste characteristics of smoking articles wherein a tobacco charge is wrapped in a cellulosic sheet having filler concentrations in the range of 14 to 60 g/m$^2$ and applying a thermally stable, at the range of temperatures encountered in a burning smoking article, alkali metal salt ash conditioner to the sheet.

10. The method, as defined in claim 9, wherein the ash conditioner is selected from the group consisting of KF, KCl, KBr, KI, NaF, NaCl, NaBr and NaI.

11. The method, as defined in claim 10, wherein the ash conditioner is applied from aqueous solution thereof and at a level of from about 2% to about 24% of the total weight of the sheet.

* * * * *